US005923299A

United States Patent [19]

Brown et al.

[11] Patent Number: 5,923,299

[45] Date of Patent: Jul. 13, 1999

[54] HIGH-POWER SHAPED-BEAM, ULTRA-WIDEBAND BICONICAL ANTENNA

[75] Inventors: Ken Brown, Yucaipa; David Crouch, Corona, both of Calif.; Pat Kratovil, Boulder, Colo.

[73] Assignee: Raytheon Company, El Segundo, Calif.

[21] Appl. No.: 08/770,223

[22] Filed: Dec. 19, 1996

[51] Int. Cl.[6] ..... H01Q 13/00

[52] U.S. Cl. ..... 343/773; 343/786

[58] Field of Search ..... 343/773, 786, 343/772; H01Q 13/00

[56] References Cited

U.S. PATENT DOCUMENTS

| | | | |
|---|---|---|---|
| 2,454,766 | 11/1948 | Brillouin | 343/773 |
| 2,599,896 | 6/1952 | Clark et al. | 343/754 |
| 2,602,894 | 7/1952 | Barrow | 343/773 |
| 3,656,166 | 4/1972 | Klopach et al. | 343/756 |

*Primary Examiner*—Hoanganh T. Le
*Assistant Examiner*—Tan Ho
*Attorney, Agent, or Firm*—Brian C. Downs; Leonard A. Alkov; Glenn H. Lenzen, Jr.

[57] ABSTRACT

A biconical antenna having fully adjustable design parameters. The biconical antenna has a coaxial feed having outer and inner conductors. A lower support structure secures a lower cone to the outer conductor. An upper support structure secures an upper cone to the inner conductor. A dielectric window support is disposed between the lower and upper support structures. To make the antenna relatively lightweight, each cone may be made of sheet metal plates that are connected to the lower and upper cone support structures. A reservoir is formed within the upper cone. Dielectric material, such as oil, is disposed within the antenna. Air bubble escape holes are disposed in the upper support structure so that air bubbles that are formed at the coaxial feed can escape to the reservoir. The holes do not allow electromagnetic power leakage between the coaxial feed and the reservoir, and the position of the holes is such that the air bubbles rise from the coaxial feed into the reservoir. Tapered dielectric material may be positioned between the upper and lower cones. A first shape tapers inwardly from the first and second cones toward the dielectric window support. A second shape tapers outwardly from the first and second cones away from the dielectric window support.

5 Claims, 6 Drawing Sheets

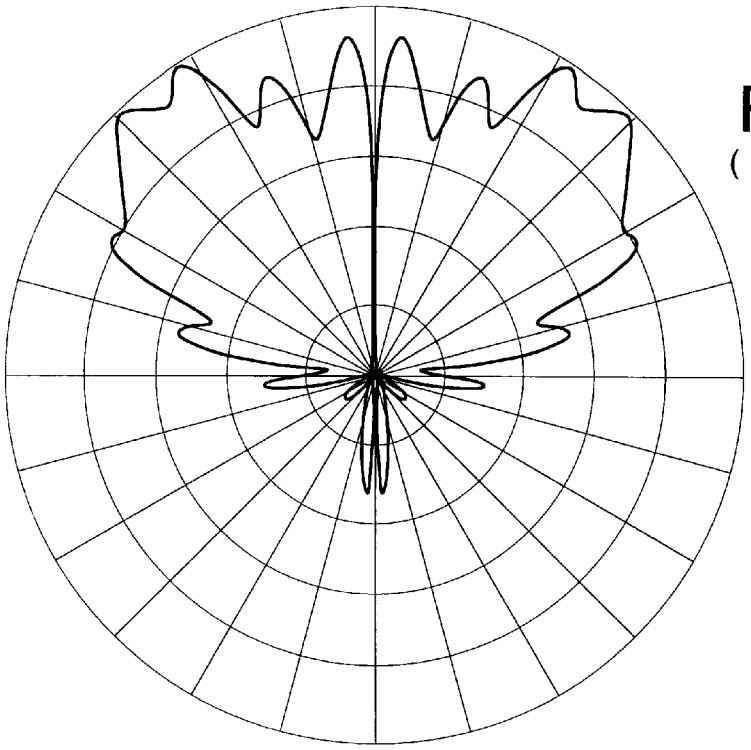
FIG. 3.
( PRIOR ART )
FIG. 4.
( PRIOR ART )
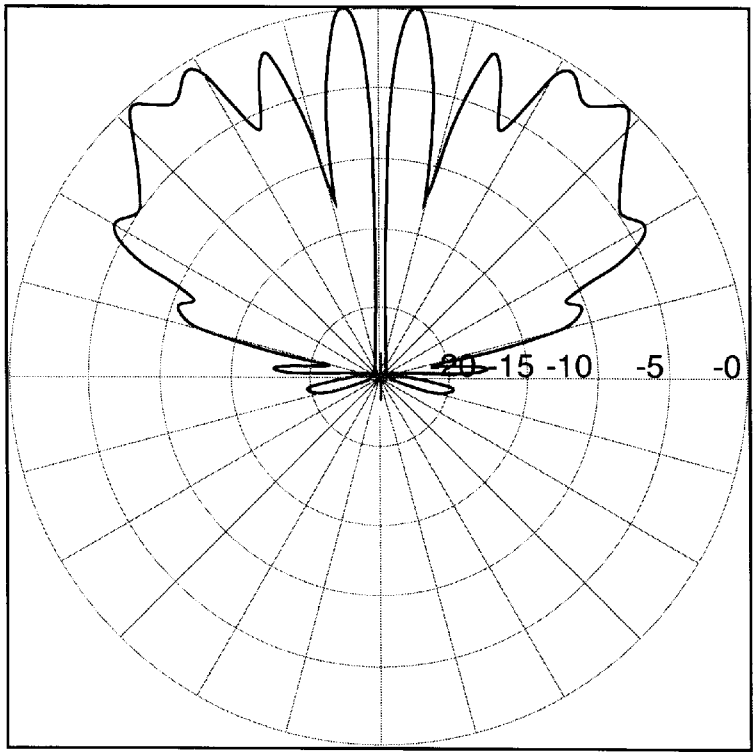

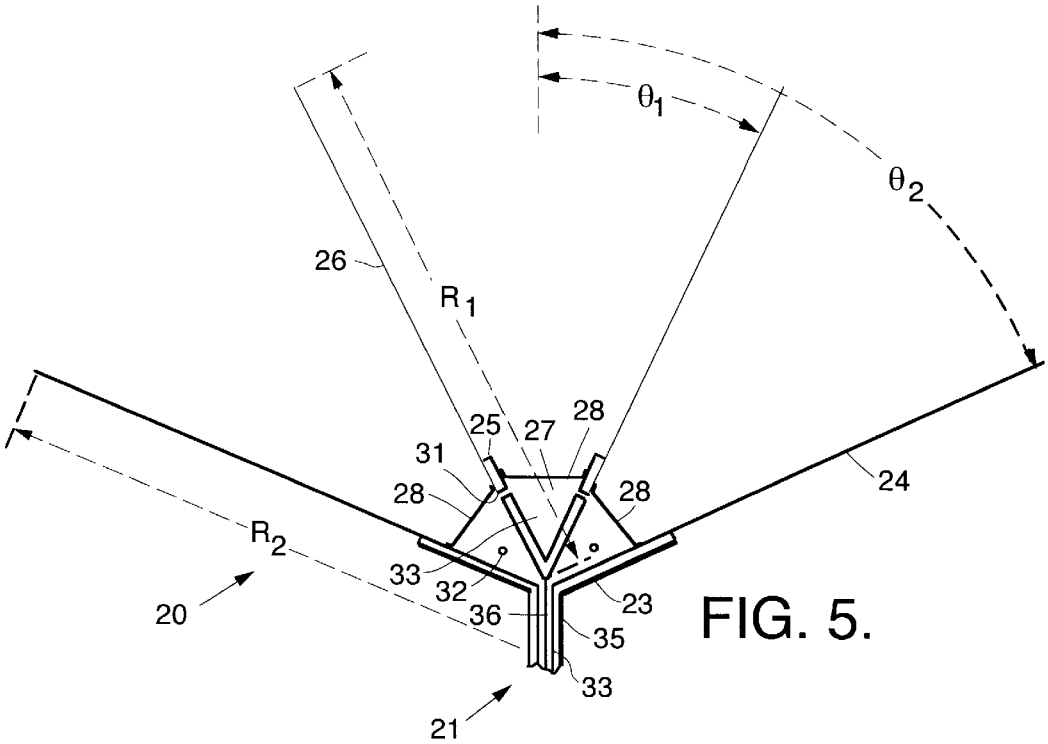
FIG. 5.
FIG. 6.
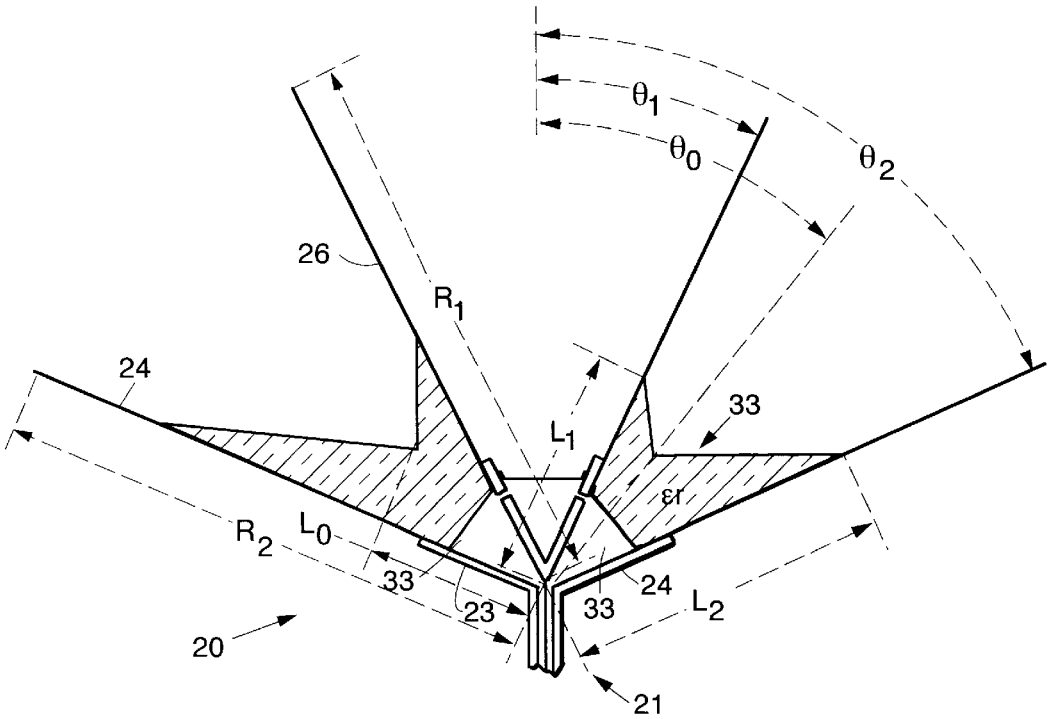

FIG.7.
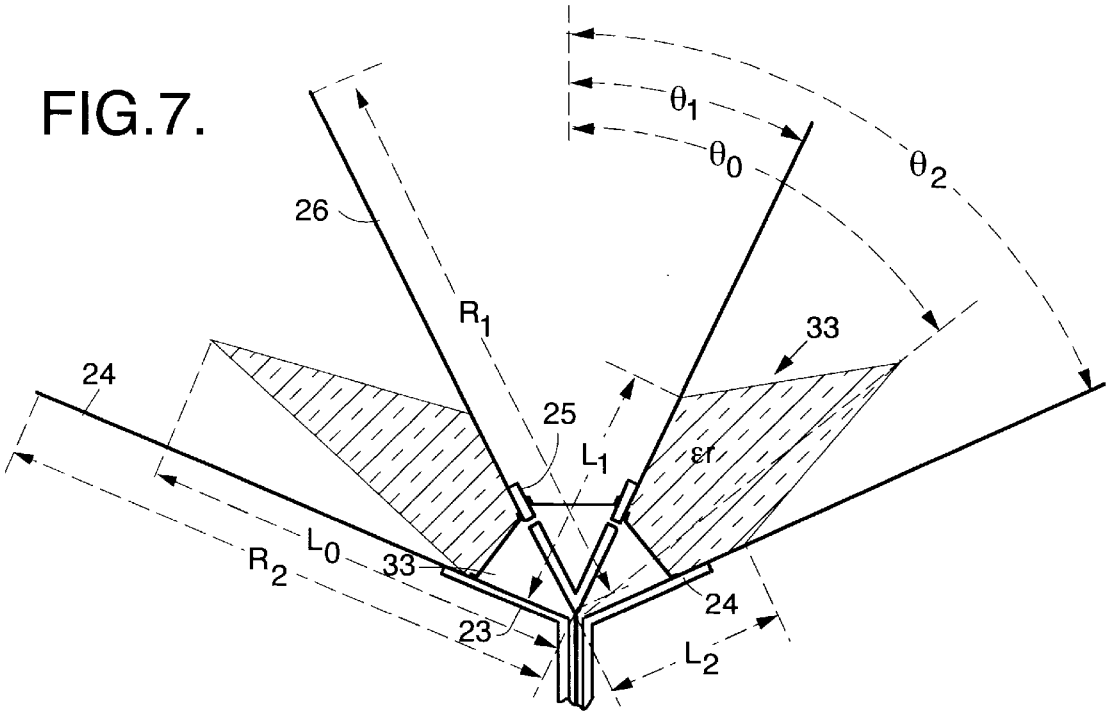
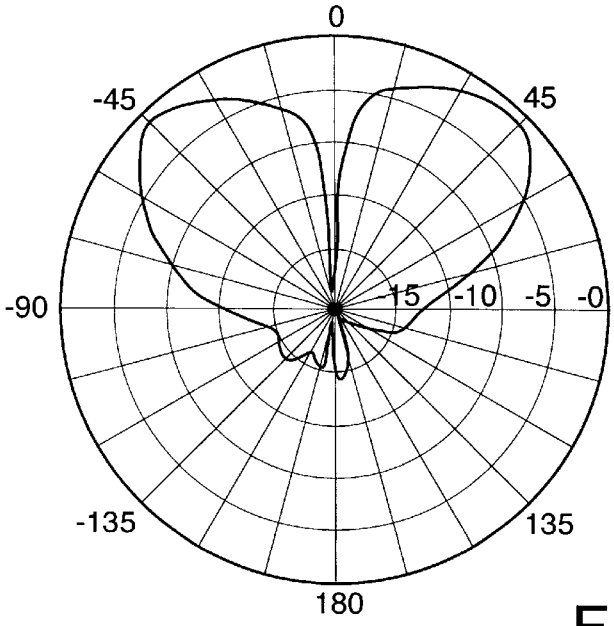
FIG. 8.

HIGH-POWER SHAPED-BEAM, ULTRA-WIDEBAND BICONICAL ANTENNA

BACKGROUND

The present invention relates generally to biconical antennas, and more particularly, to an improved high-power, shaped-beam, ultra-wideband biconical antenna.

A biconical antenna is used in a system that requires a 360 degree coverage in the azimuthal plane with a particular coverage in the elevation plane. Due to the frequency independent nature of its construction, the biconical antenna is well-suited for use in ultra-wideband systems. For uncorrupted transmission of time-domain waveforms, the biconical antenna must be designed such that its gain is semi-flat as a function of frequency.

The basic biconical antenna and its associated theory is described in detail in a book by J. D. Kraus entitled *Antennas*, published by McGraw-Hill, for example. None of the unique features of the present invention are discussed in this book. Also papers have been written on the subject of biconical antennas. However, a literature search through the IEEE Antennas and Propagation Transactions yielded no papers that described the unique features associated with the present invention.

Several companies manufacture various derivatives of the basic biconical antenna. One such manufacturer is Tecom Industries Inc. Their biconical antennas include part numbers 201093, 201464 and 201125. It is not believed that these antennas do not have any of the unique features described herein.

Three important characteristics of a biconical antenna are its input impedance, beam characteristics in the elevation plane, and the flatness of its gain as a function of frequency. With conventional biconical antennas, a system specification cannot be met that includes all three of these parameters. For example, the conventional biconical antenna has only three parameters that can be adjusted: the upper and lower cone angles, $\theta_1$ and $\theta_2$ and the length of the upper and lower cones, $R_1$ and $R_2$. Once the angles $\theta_1$ and $\theta_2$ have been determined, the antenna input impedance is set. Since the beam characteristics and gain flatness are both influenced by $R_1$ and $R_2$, it is impossible to adjust both independently.

Therefore, it is an objective of the present invention to provide for an improved high-power, shaped-beam, ultra-wideband biconical antenna that permits flexible adjustment of its operating characteristics.

SUMMARY OF THE INVENTION

To meet the above and other objectives, the present invention is a high-power, shaped-beam, ultra-wideband biconical antenna having fully adjustable design parameters to provide for maximum performance. The biconical antenna has a coaxial feed with outer and inner conductors. A lower support structure secures a lower cone to the outer conductor of the coaxial feed. An upper support structure secures an upper cone to the inner conductor of the coaxial feed. A dielectric window support is disposed between the lower and upper support structures. A reservoir is formed within the upper cone. A dielectric material such as oil is disposed within the volume defined by the lower and upper cone supports, the coaxial feed and the dielectric window support. A plurality of air bubble escape holes are disposed in the upper support that provide a means for air bubbles that are formed at the coaxial feed to escape to the reservoir. The dielectric material, which may include a solid dielectric material having a dielectric constant approximately equal to that of the oil, may be configured to have one of two types of tapers. A first shape tapers inwardly from the first and second cones toward the dielectric window support. The second shape tapers outwardly from the first and second cones away from the dielectric window support.

The biconical antenna includes lower and upper cone supports that provide rigid construction around the coaxial feed of the antenna, where the coaxial line connects to the cones. These supports also function as a first portion of each cone. In order to make the antenna relatively lightweight, the remainder of each cone is made of sheet metal plates that are connected to the lower and upper cone support structures. This combination of cone support structures and sheet metal plates allow for a relatively lightweight but rigid antenna system.

For a biconical antenna to function under the application of extremely high power, the feed area of the antenna is enclosed in dielectric material, which is preferably oil. The dielectric window support allows the feed area of the antenna to be filled with dielectric oil. The dielectric window support also provides mechanical support between the upper and lower cones. Additional mechanical support may be provided by an optional radome (not shown) coupled to the ends of the upper and lower cones, if desired.

When using oil as the dielectric material, it is crucial that air bubbles do not exist in the oil. The existence of air bubbles in the oil could cause a dielectric breakdown problem during the application of high power to the antenna. The design of the biconical antenna eliminates air bubbles within the antenna and coaxial feed. An oil reservoir is located inside the upper cone and is disposed away from high power that is applied between the upper and lower cones. Small holes that do not allow electromagnetic power leakage are drilled between the feed section and the reservoir. The position of these holes is such that the air bubbles rise from the coaxial feed into the reservoir.

A key feature of the biconical antenna is that it includes dielectric tapering. The use of this dielectric tapering allows the simultaneous adjustment of the antenna input impedance, beam characteristics and gain flatness. The first type of dielectric taper used in the biconical antenna is longer at the surface of the cones than in its middle. The second type of taper is shorter at the surface of the cones than in its middle. By adjusting the cone lengths ($R_1$ and $R_2$), cone angles, the dielectric constant $\epsilon_r$ of the oil and of the tapers (which should be approximately equal), and the shape of the tapers (defined by $L_1$, $L_2$, $L_0$ and $\theta_0$), the antenna input impedance, beam characteristics and gain flatness can be simultaneously adjusted.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 3 illustrates the predicted beam pattern of the conventional biconical antenna operating at 14 GHz;

FIG. 4 illustrates the measured beam pattern of the conventional biconical antenna of FIG. 1 operating at 14 GHz;

FIG. 5 illustrates an improved biconical antenna in accordance with the principles of the present invention and its relevant dimensions;

FIG. 6 illustrates the present biconical antenna having a first type of tapering dielectric;

FIG. 7 illustrates the present biconical antenna having a second type of tapering dielectric;

FIG. 8 illustrates the measured beam pattern of the biconical antenna of FIG. 5 operating at 14 GHz;

DETAILED DESCRIPTION

The analysis and design of both a conventional biconical antenna and the improved biconical antenna of the present invention are discussed herein. As will be shown, the present biconical antenna offers far more flexibility in achieving system requirements than the conventional biconical antenna.

Figure 1:
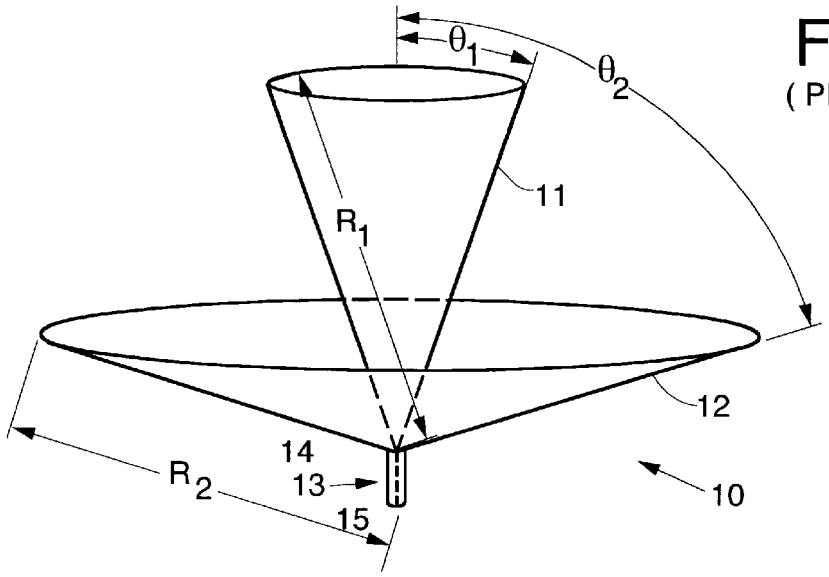
FIG. 1. ( PRIOR ART )
FIG. 1 illustrates a conventional biconical antenna and its relevant dimensions.

Referring to the drawing figures, FIG. 1 illustrates a conventional biconical antenna 10 and its pertinent dimensions. The conventional biconical antenna 10 includes upper and lower coaxial cones 11, 12. The lower cone 12 is connected to an outer conductor 14 of a coaxial feed 13 and the upper cone 11 is connected to a center conductor 15 of the coaxial feed 13. Many biconical antennas are symmetric, in that the lower cone 12 is a mirror image of the upper cone 11.

Pertinent dimensions of the conventional biconical antenna 10 include the length of the upper and lower cones 11, 12 ($R_1$ and $R_2$) and upper and lower cone angles ($\theta_1$ and $\theta_2$), respectively. These three dimensions determine the input impedance, beam center (in an elevation plane), beam width (also in the elevation plane) and the gain flatness of the antenna 10. It is impossible to simultaneously meet all of these requirements by only adjusting $R_1$ and $R_2$, $\theta_1$ and $\theta_2$. For this, and other reasons, the present biconical antenna was invented.

The open literature contains references to analysis of conventional biconical antennas. In general, the analysis is either too simplified or too complicated for a quick but accurate description of the radiated fields of the biconical antenna 10. Therefore, a relatively simple, but accurate equation was derived that gives the radiated fields of the biconical antenna 10. This derivation uses the fields of an infinitely long biconical antenna 10 as its starting point.

For an infinitely large biconical antenna 10 ($R=\infty$), the time harmonic (having an $e^{-j\omega t}$ time dependence) electric field vector (E) and magnetic field vector (H) within the two cones ($\theta_1<\theta'<\theta_2$) have been found to be $$E = \hat{\theta}' \cdot \frac{E_0 e^{-j\beta_0 r'}}{r' \sin\theta'} \tag{1}$$

and

-continued $$H = \hat{\varphi}' \cdot \frac{E_0 e^{-j\beta_0 r'}}{\eta_0 r' \sin\theta'} \tag{2}$$

where r', θ' and φ' define a spherical coordinate system, $\beta_0$ is the wave number ($2\pi/\lambda$), $n_0$ is the characteristic impedance of free space (≈377 Ω) and $\hat{\theta}'$ and $\hat{\varphi}'$ are unit vectors in the direction of increasing θ' and φ' respectively. Equations (1) and (2) represent an outward propagating TEM (transverse electromagnetic) wave. The constant $E_0$ is $$E_0 = \frac{\eta_0 V_0}{2\pi Z_{in}} \tag{3}$$

where $V_0$ is the voltage applied between the upper and lower cones at their apex and $Z_{in}$ is the input impedance of the infinite biconical antenna defmed by $$Z_{in} = \frac{\eta_0}{2\pi}\left[\frac{\tan\left(\frac{\theta_2}{2}\right)}{\tan\left(\frac{\theta_1}{2}\right)}\right]. \tag{4}$$

The following derivations manipulate the above equations for an infinite biconical antenna 10 into useful approximations for finite biconical antennas 10. In order to do so, the following approximations are made. First, the input impedance of the finite biconical antenna 10 is assumed to be identical to that of the infinite biconical antenna 10. Except at relatively low frequencies this is a good approximation. Second, the fields at the ends of the finite biconical antenna 10 are assumed to be the same as the fields at the same location in the infinite biconical antenna 10. As will be shown in this report, this is also a very good approximation.

Figure 2:
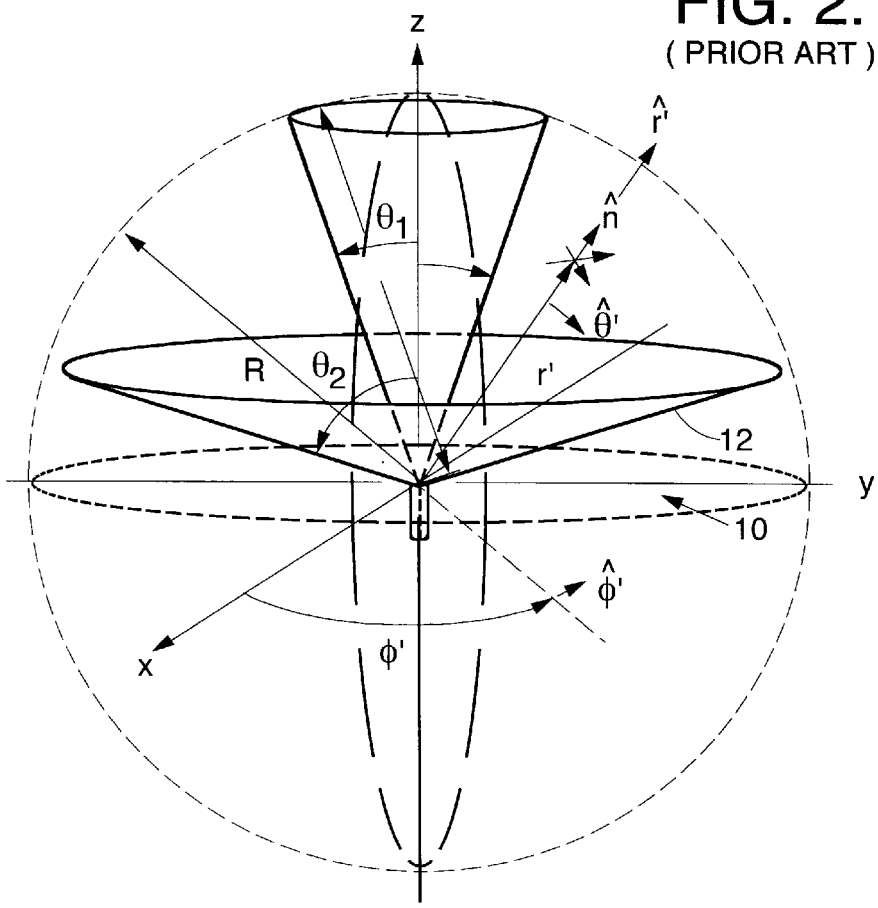
FIG. 2. ( PRIOR ART )
FIG. 2 illustrates a surface used to define equivalent currents for a biconical antenna.

The equation that gives the radiated fields of a finite conventional biconical antenna 10 is developed from the fields of the infinite biconical antenna 10 using Love's equivalence principle. This principle states that if the electric and magnetic fields on an enclosed surface that surrounds a source (the antenna 10) are known, then the source can be replaced by equivalent electric and magnetic current densities located on the surface. These equivalent electric ($J_s$) and magnetic ($M_s$) surface current densities are $$J_s = \hat{n} \times H \tag{5}$$

and $$M_s = -\hat{n} \times E, \tag{6}$$

where E and H are the electric and magnetic field vectors (generated by the antenna 10) on the enclosed surface, respectively and $\hat{n}$ is the unit vector normal to the surface. The surface that is used to analyze the biconical antenna 10 is a sphere of radius R (the length of either cone), as shown in FIG. 2.

The fields at the ends of the two finite cones 11, 12 ($H_1 \leqq \theta' \leqq H_2$) at a distance R are assumed to be the same as the fields in an infinite biconical antenna 10 at a distance of r'=R. The fields at the surface of the sphere outside the two cones 11, 12 ($\theta'<\theta_1$ and $H'>H_2$) are assumed to be zero. With these fields, the equivalent surface current densities can be found on the r'=R sphere, using Equations (5) and (6).

The equivalent currents are known on this sphere, and the radiated fields can be computed using the far field approximation of a free-space dyadic Green's function for electric and magnetic fields. These equations are $$E_e = \frac{-j\omega\mu_0}{4\pi}\frac{e^{-j\beta_0 r}}{r}\int_0^{\pi}\int_0^{2\pi}[J_s-(J_s-\hat{r})\hat{r}]e^{j\beta_0 R(\hat{r}'\cdot\hat{r})}R^2\sin\theta' d\phi' d\theta' \quad (7)$$

and $$E_m = \frac{-j\beta}{4\pi}\frac{e^{-j\beta_0 r}}{r}\int_0^{\pi}\int_0^{2\pi}(\hat{r}-M_s)e^{j\beta_0 R(\hat{r}'\cdot\hat{r})}R^2\sin\theta' d\phi' d\theta' \quad (8)$$

where $E_e$ and $E_m$ are the radiated electric field vectors generated by the electric and magnetic current densities respectively, r, θ and φ define a spherical coordinate system in the far field and r is the unit vector pointing in the direction of increasing r. The total radiated electric field vector ($E_{rad}$) is the sum of $E_e$ and $E_m$. Inserting Equations (1), (2), (5) and (6) into Equations (7) and (8) yields $$E_{\text{rad}} = \hat{\theta}\frac{j\beta_0}{2}\frac{e^{-j\beta_0 r+R}}{r}RE_0\int_{\theta_1}^{\theta_2}e^{j\beta_0 R\cos\theta' os\theta}sF d\theta', \quad (9)$$

where $$F=(\sin\theta'\sin\theta)J_0(\beta R\sin\theta'\sin\theta)+j(1+\cos\theta'\cos)J_1(\beta R\sin\theta'\sin\theta). \quad (10)$$

In Equation (10), $J_0$ and $J_1$ are Bessel functions of the first kind ($0^{th}$ and $1^{st}$ order), and $\hat{\theta}$ is a unit vector in the direction of increasing θ. Since there is only one vector component in the radiated field ($\hat{\theta}$), the polarization of the electric field is strictly vertical.

Equation (9) is used to predict the radiated fields of a conventional biconical antenna 10. The predicted beam pattern of the conventional biconical antenna 10 using Equation (9) at 14 GHz is shown in FIG. 3. The measured beam pattern of this antenna 10 at 14 GHz is shown in FIG. 4. As can be seen by the comparison of FIGS. 3 and 4, Equation (9) has predicted the beam pattern of the antenna 10 very well.

With the above in mind, and referring to FIG. 5, it illustrates a biconical antenna 20 in accordance with the principles of the present invention. The biconical antenna 20 is a high-power, shaped-beam, ultra-wideband biconical antenna 20 whose design parameters may be fully adjusted to provide for maximum performance. The biconical antenna 20 comprises a coaxial feed 21 that is filled with a dielectric material 33 such as oil 33. A lower support structure 23 is coupled to an outer conductor 35 of the coaxial feed 21. The lower support structure 23 secures a lower cone 24 and couples it to the coaxial feed 21. An upper support structure 25 is coupled to an inner conductor 36 of the coaxial feed 21. The upper support structure 25 secures an upper cone 26 and couples it to the inner conductor 36 of the coaxial feed 21. A dielectric window support 28 is disposed between the lower and upper support structures 23, 25. A reservoir 27 is defined by the upper cone 26 and one dielectric window support 28 that is secured to the upper cone 26. Oil 33, for example, is disposed within the volume defined by the lower and upper cone support structures 23, 25 and the dielectric window support 28. A plurality of air bubble escape holes 31 are disposed in the upper support 25 that provide a means for air bubbles 32 that form between the lower and upper support structures 23, 25 to escape to the reservoir 27. Dielectric material 34 is disposed between the lower and upper cones 24, 26 and the dielectric window support 28 (see FIG. 6). The dielectric material 34 is configured to have one of two types of tapered shapes. A first shape tapers inwardly from the lower and upper cones 24, 26 toward the dielectric window support 28. The second shape tapers outwardly from the lower and upper cones 24, 26 away from the dielectric window support 28. The dielectric material may be a confined liquid or may be a solid.

The lower and upper cone supports 23, 25 provide rigid construction around the coaxial feed 21 of the antenna 20, where the coaxial line connects to the cones 24, 25. The supports 23, 25 also function as the first portion of the cones 24, 26. In order to make the antenna relatively lightweight, the remainder of each cone is made from sheet metal plates that are bolted onto, or otherwise connected to, the lower and upper cone support structures 23, 25. This combination of cone support structures 23, 25 and sheet metal plates allow for a relatively lightweight but rigid antenna 20.

For the biconical antenna 20 to function when extremely high power is applied, the coaxial feed 21 must be enclosed in dielectric material 33, preferably comprising oil 33. The dielectric window support 28 allows the feed area of the antenna 20 to be filled with a liquid dielectric material 33. The dielectric window support 28 also provides mechanical support between the upper and lower cones 24, 26. Additional mechanical support may be provided by an optional radome (not shown) coupled to the ends of the upper and lower cones 24, 26, if desired.

When using oil 33 as the dielectric material 33, air bubbles 32 that are created must not remain in the oil 33. The existence of air bubbles 32 in the oil 33 could causes dielectric breakdown during the application of high power to the antenna 20. The biconical antenna 20 removes air bubbles 32 that are formed within the antenna 20 and coaxial feed 21. The reservoir 27 is located inside the upper cone 26 and is disposed away from high power that is applied between the upper and lower cones 24, 26. Small holes 31 that do not allow electromagnetic power leakage are drilled between the coaxial feed 21 and the reservoir 27. The position of these holes 31 is such that the air bubbles 32 rise from the coaxial feed 21 into the reservoir 27.

The biconical antenna 20 has several unique features that are described herein. However, the feature that most affects the electrical characteristics (such as beam shape and gain flatness) of the antenna 20 is the addition of a dielectric taper in the interior of the biconical antenna 20. Although the other features of the biconical antenna 20 are important, they have little effect on the electrical performance of the antenna 20. Therefore, only the dielectric taper is discussed herein. FIGS. 6 and 7 illustrate two versions of the biconical antenna 20 which employ the use of tapered dielectric material 34.

The effect of the tapered dielectric material 34 can be defined by the relative dielectric constant of the material 34 ($\epsilon_T$), the lengths $L_1$, $L_2$ and $L_0$ and the angles $\theta_1$, $\theta_2$ and $\theta_0$. It is also assumed that the biconical antenna 20 may have cones 24, 26 with different lengths defined by $R_1$ and $R_2$ (although in the following analysis they are both assumed to be equal to R). Careful design of the taper of the tapered dielectric material 34, along with the cone lengths and angles, allows for tuning of the input impedance, beam center, beam width and gain flatness of the biconical antenna 20.

The addition of the tapered dielectric material 34 considerably complicates the analysis of the biconical antenna 20. However, a relatively fast analysis method that approximates the fields in an infinite biconical antenna 20 with dielectric tapers has been developed. The conversion of the fields from an infinite biconical antenna 20 to a finite biconical antenna 20 is done in a similar manner as discussed above with reference to the conventional biconical antenna 10.

The field inside the dielectric taper generated by the coaxial feed 21 is assumed to be TEM in nature. These fields can be written as $$E_\theta^1 = \frac{-j\eta_0}{\mu\sqrt{\varepsilon_r}} P_0(\cos\theta_1) \frac{e^{-j\sqrt{\varepsilon_r}\,\beta_0 r'}}{Q_0(\cos\theta_1) r' \sin\theta'} \tag{11}$$

and $$H_\theta^1 = \frac{-j}{\mu} P_0(\cos\theta_1) \frac{e^{-j\sqrt{\varepsilon_r}\,\beta_0 r'}}{Q_0(\cos\theta_1) r' \sin\theta'}, \tag{12}$$

where $P_0$ and $Q_0$ are zero$^{th}$ order Legendre functions of the first and second kind, respectively. Equations (11) and (12) are identical to Equations (1) and (2), except for constants that were added to facilitate the following analysis.

Due to the geometry of an infinite biconical antenna 20, its interior fields can be described by an infinite summation of discrete modes, similar to what is done with rectangular wavegulides. To solve for the fields, one needs to determine the coefficients or weighting constants for each individual mode. This is accomplished by imposing boundary conditions that exist for a particular geometry.

It can be shown that the transmitted fields radiating outward (in air outside of the dielectric tapers) in an infinite biconical antenna 20 excited by an axially symmetric vertical probe can be written as $$E_{r'}^T = \sum_{n=1}^{\infty} \frac{T_n}{j\omega\varepsilon_0} \sqrt{\frac{\pi\beta_0}{2}} \frac{(v+1)v}{r'^{3/2}} H_{v+1/2}^{(2)} \beta_0 r' \left[ P_v(\cos\theta') \frac{P_v(\cos\theta_1)}{Q_v(\cos\theta_1)} Q_v(\cos\theta') \right] \tag{13}$$

$$E_\theta^T = \sum_{n=1}^{\infty} \frac{T_n}{j\omega\mu\varepsilon_0 r'} \left[ \sqrt{\frac{\pi\beta_0}{2}} \left\{ \frac{v+1}{r'^{1/2}} H_{v+1/2}^{(2)} \beta_0 r' - \beta_0 r'^{1/2} H_{v+3/2}^{(2)} \beta_0 r' \right\} \right] \times \left[ \frac{v+1}{\sin\theta'} \left\{ P_{v+1}(\cos\theta') - \cos\theta' P_v|\cos\theta') - \frac{P_v|\cos\theta_1)}{Q_v|\cos\theta_1)} (Q_{v+1}(\cos\theta') - \cos\theta' Q_v(\cos\theta')) \right\} \right] \tag{14}$$

and $$H_\phi^T = \sum_{n=1}^{\infty} \frac{-T_n}{\mu r'^{1/2}} \left[ \sqrt{\frac{\pi\beta_0}{2}} H_{v+1/2}^{(2)} \beta_0 r' \right] \times \left[ \frac{v+1}{\sin\theta'} \left\{ P_{v+1}(\cos\theta') - \cos\theta' P_v|\cos\theta') - \frac{P_v|\cos\theta_1)}{Q_v|\cos\theta_1)} (Q_{v+1}(\cos\theta') - \cos\theta' Q_v(\cos\theta')) \right\} \right] \tag{15}$$

In Equations (13) through (15), $E_r^T$ and $E_\Theta^T$ are the transmitted electric fields polarized in the $\hat{r}'$ and $\hat{\theta}'$ directions, $H_\Phi^T$ is the transmitted magnetic field polarized in the $\hat{\theta}'$ direction and $T_n$ is the coefficient for the n$^{th}$ transmitted mode. All other wave components can be shown to be zero. It can also be shown that the reflected fields radiating inward (in the dielectric tapers) can be written as $$E_r^R = \sum_{n=1}^{\infty} \frac{R_n}{j\omega\mu\varepsilon_r\varepsilon_0} \sqrt{\frac{\pi\varepsilon_r\beta_0}{2}} \frac{(v+1)v}{r'^{3/2}} H_{v+1/2}^{(1)}(\sqrt{\varepsilon_r}\,\beta_0 r') \left[ P_v(\cos\theta') - \frac{P_v(\cos\theta_1)}{Q_v(\cos\theta_2)} Q_v(\cos\theta') \right] \tag{16}$$

-continued $$E_\theta^R = \sum_{n=1}^{\infty} \frac{R_n}{j\omega\mu\varepsilon_r\varepsilon_0 r'} \left[ \sqrt{\frac{\pi\varepsilon_r\beta_0}{2}} \left\{ \frac{v+1}{r'^{1/2}} H_{v+1/2}^{(1)}(\sqrt{\varepsilon_r}\,\beta_0 r') - \sqrt{\varepsilon_r}\,\beta_0 r'^{1/2} H_{v+3/2}^{(1)} \sqrt{\varepsilon_r}\,\beta_0 r' \right\} \right] \times \left[ \frac{v+1}{\sin\theta'} \left\{ P_{v+1}(\cos\theta') - \cos\theta' P_v|\cos\theta') - \frac{P_v|\cos\theta_1)}{Q_v|\cos\theta_2)} (Q_{v+1}(\cos\theta') - \cos\theta' Q_v(\cos\theta')) \right\} \right] \tag{17}$$

and $$H_\phi^R = \sum_{n=1}^{\infty} \frac{-R_n}{\mu r'^{1/2}} \left[ \sqrt{\frac{\pi\sqrt{\varepsilon_r}\,\beta_0}{2}} H_{v+1/2}^{(1)}(\sqrt{\varepsilon_r}\,\beta_0 r)' \right] \times \left[ \frac{v+1}{\sin\theta'} \left\{ P_{v+1}(\cos\theta') - \cos\theta' P_v|\cos\theta') - \frac{P_v(\cos\theta_1)}{Q_v(\cos\theta_2)} (Q_{v+1}(\cos\theta') - \cos\theta' Q_v(\cos\theta')) \right\} \right]. \tag{18}$$

In Equations (16) through (18), $E_{r'}^R$ and $E_{\theta'}^R$ are the reflected electric fields in the $\hat{r}'$ and $\hat{\theta}'$ directions, $H_{100}{}'^R$ is the reflected magnetic field in the $\hat{\phi}'$ direction and $R_n$ is the coefficient for the n$^{th}$ reflected mode. In Equations (13) through (18), $H^{(1)}$, $H^{(2)}$, P and Q are Hankel functions of the first and second kind and Legendre functions of the first kind and second kind, respectively. The use of $H^{(1)}$ for the reflected fields requires the assumption that all reflected energy is absorbed back into the coaxial feed 21. The eigenvalues, v are the only functions of n. The first solution for v (n=1) can be shown to be zero, which corresponds to a TEM wave. The rest of the values for v (n=2 through infinity) are found by solving $$P_v(\cos\theta_1)Q_v(\cos\theta_2) - P_v(\cos\theta_2)Q_v(\cos\theta_1) = 0 \tag{19}$$

which can be solved using numerical methods. Equations (13)–(18) are exact only in spherical cuts of either pure dielectric or air. However, they can be used to approximate the fields at a non-spherical dielectric-to-air boundary in the tapered region. Matching boundary conditions at the dielectric-to-air interface, the equations $$\hat{t}\cdot(\hat{r}E_r^T+\hat{\theta}E_\theta^T)-\hat{t}\cdot(\hat{r}E_r^R+\hat{\theta}E_\theta^R)=\hat{t}\cdot E_\theta^I \tag{20}$$

and $$H_\phi^T-H_\phi^R=H_\phi^I \tag{21}$$

are formed, where t is the unit vector tangential to the interface between the dielectric tapering and air. Equations (20) and (21) can be solved for a finite number of the coefficients $T_n$ and $R_n$ using numerical methods. In practice, only about ten modes are necessary to adequately determine the fields of the antenna 20. Once the coefficients $T_n$ are found, the equation $$E_{\text{rad}}=\hat{\theta}'\frac{-j\beta_0}{2}\frac{e^{-j\beta_0(r+R)}}{r}R^2\int_{\theta_1}^{\theta_2}e^{j\beta_0 R\cos\theta'\cos\theta}G\,d\theta', \tag{22}$$

where $$G=(jE_\theta^{T+\eta_0}H_\phi^T\cos\theta'\cos\theta)\,J_1(\beta R\sin\theta'\sin\theta)+\eta_0H_\phi^T\sin\theta'\sin\theta J_0(\beta R\sin\theta'\sin\theta), \tag{23}$$

can be used to find the radiated field of the finite biconical antenna 20. Equations (22) and (23) were developed in a similar manner to Equations (9) and (10).

Equations (11) through (23) may be used to quickly approximate the radiated fields of an biconical antenna 20. FIG. 6 illustrates the biconical antenna 20 having a first type of tapering dielectric material 34, while FIG. 7 illustrates a second type of tapering dielectric material 34. The antenna 20 shown in FIG. 6 is the same antenna 20 shown in FIG. 5, but with a dielectric taper added to it. The measured beam pattern of the antenna 20 of FIG. 5, using an ultra-wideband impulse waveform, using Equation (22) is shown in FIG. 8. This pattern demonstrates the ultra-wideband capability of the antenna 20.

The design of the biconical antenna 20 may have the following system requirements: $\theta_c$ is the beam center (in the elevation plane), $\theta_w$ is the beam width (in the elevation plane), $F_L$ is the lowest frequency of operation (with flat gain at frequencies greater than $F_L$), and $Z_{in}$ is the input impedance. The purpose of adding the dielectric taper to the biconical antenna 20 is three-fold. First, the tapered dielectric material 34 allows a gradual impedance change from the dielectric material 34 in the coaxial feed 21 to the air within the biconical antenna 20. Second, the taper makes the phase of the electromagnetic wave at the aperture of the antenna 20 nonuniform, and may be used to broaden or narrow the antenna beam as required. Third, the nonuniform aperture phase caused by the taper may be used to flatten the antenna gain as a function of frequency. Since the gain of an antenna with a constant size aperture normally increases as the frequency increases, the aperture phase error, which increases as a function of frequency, tends to flatten the gain. The aperture phase error is the phase difference between the edge of the antenna aperture (at $\theta_1$ or $\theta_2$) and the center of the aperture.

As with the conventional biconical antenna 10, the system requirements for the biconical antenna 20 could be: $\theta_c$, which is the beam center (in the elevation plane), $\theta_w$, which is the beam width (in the elevation plane), $F_L$, which is the lowest frequency of operation (with flat gain at frequencies greater than $F_L$), and $Z_{in}$, which is the input impedance. The parameters available for adjustment in the improved biconical antenna are: $\theta_1$, which is the upper cone angle, $\theta_2$, which is the lower cone angle, $R_1$ and $R_2$, which are the upper and lower cone length, $\epsilon_r$, which is the dielectric constant of taper, $L_1$, which is the upper dielectric length, $L_2$, which is the lower dielectric length, $L_0$, which is the center dielectric length, and $\theta_0$, which is the Center dielectric angle.

As with most antennas, the optimal design of the biconical antenna 20 is obtained by iteration. The analysis technique described above is fast enough to be used as an iterative design tool. However, a reasonably good design is required for the first iteration. The following design procedure has been developed to find this starting point. Once the starting point is found, the above antenna parameters can be iterated, until the system requirements are best met.

Step 1: Find the upper and lower cone angles, $\theta_1$ and $\theta_2$. The value of $\theta_1$ can be approximated from.

$$\tan\frac{\theta_1}{2}\cong\frac{-(C+1)+\sqrt{(C+1)2+4\tan^2\theta_c}}{2C\tan\theta_c}, \tag{24}$$

where $$C\cong\exp\left\{\frac{2\pi Z_{in}\sqrt{\varepsilon_r}}{377}\right\}. \tag{25}$$

Since it is difficult to set exact values for a dielectric constant, it is assumed that the value for $\epsilon_r$ is known. Once $\theta_1$ is found, $\theta_2$ can be approximated by $$\theta_2\cong\theta_C-\theta_1. \tag{26}$$

Equations (24) through (26) were developed from Equation (4) by determining the values of $\theta_1$ and $\theta_2$ can that make the input impedance $Z_{in}$ of the antenna 20 and the midpoint between the angles $\theta_c$, the desired beam center.

Step 2: Find the lengths $R_1$ and $R_2$ of the upper and lower cones 23, 25. The values for $R_1$ and $R_2$ are approximated from.

$$R_1=R_2\cong\frac{50\lambda_L}{\theta_w\sin\left(\frac{\theta_2-\theta_1}{2}\right)}, \tag{27}$$

where $$\lambda_L=\frac{c}{F_L}. \tag{28}$$

Equation (27) was developed by determining the length $R_1$ and $R_2$ of the upper and lower cones 26, 24, such that the beam width, $\theta_w$, is approximately obtained for the lowest frequency of operation, $F_L$. Step 5 of this procedure insures that the gain, and thus the beamwidth, remains semi-constant at all higher frequencies.

Step 3: Find the dielectric center, $\theta_0$. The value of $\theta_0$ can be approximated by $$\theta_0=\frac{\theta_1+\theta_2}{2}=\theta_c. \tag{27}$$

which is the mid-point between the cones 24, 26. In practice this is a good approximation, especially if $\theta_0$ is close to 90 degrees.

Step 4: Assume that $$L_2=L_1 \tag{28}$$

Different values for $L_1$ and $L_2$ can be determined as the design is iterated.

Step 5: Find the length of the dielectric taper $\Delta L=L_1-L_0$. The taper length can be approximated by.

$$\Delta L = L_1 - L_0 \cong \frac{\dfrac{R\sin^2\left(\dfrac{\theta_2-\theta_1}{2}\right)}{8\cos\left(\dfrac{\theta_2-\theta_1}{2}\right)}}{\left(\sqrt{\varepsilon_r}-1\right)}. \tag{29}$$

Equation (29) was developed by determining the taper length, $L_1$–$L_0$ such that the aperture phase error is equal to 90 degrees at the lowest operating frequency, $F_L$. The length $L_0$ can be determined from either mechanical or power requirements (the center of the biconical antenna 20 needs a certain amount of dielectric to withstand a large amount of power). Once $L_0$ is known, L1 can be found from $$L_1 = \Delta L + L_0. \tag{30}$$

As an example of the above design procedure, the following arbitrary system requirements are desired for a biconical antenna 20: $\theta_c$=50 degrees (beam center in the elevation plane), $\theta_w$=60 degrees (beam width in the elevation plane), $F_L$=1 GHz (lowest frequency of operation), and $Z_{in}$=50 ohms (input impedance). Also, it is desirable to use a dielectric with $\epsilon_r$=2.1 (corresponding to Teflon).

Using Step 1, $\theta_1 \cong 25.6$ degrees and $\theta_1 \cong 74.4$ degrees. From Step 2, R≅23.8". Using Steps 3 and 4, $\theta_0 \cong 50$ degrees and $L_2 = L_1$ respectively. From Step 5, $\Delta_L = L_1 - L_0 \cong 5.3$". If it is assumed that $L_0 \cong 6$", then $L_1 = L_2 \cong 11.3$". This above geometry was analyzed to yield the beam pattern shown in FIGS. 9–11 for frequencies of 1, 3 and 5 GHz, respectively.

Figure 9:
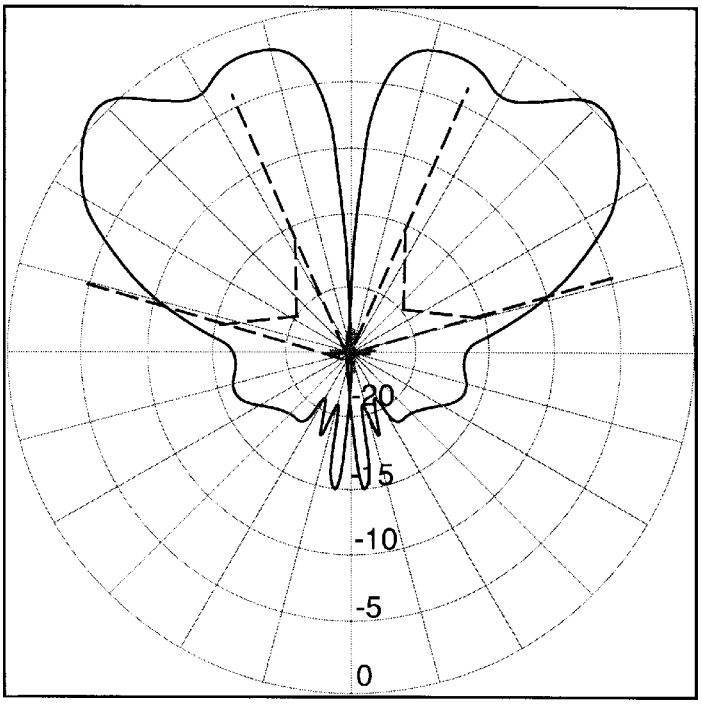
FIG. 9 illustrates the predicted beam pattern of a design example of the present biconical antenna operating at 1 GHz.
Figure 10:
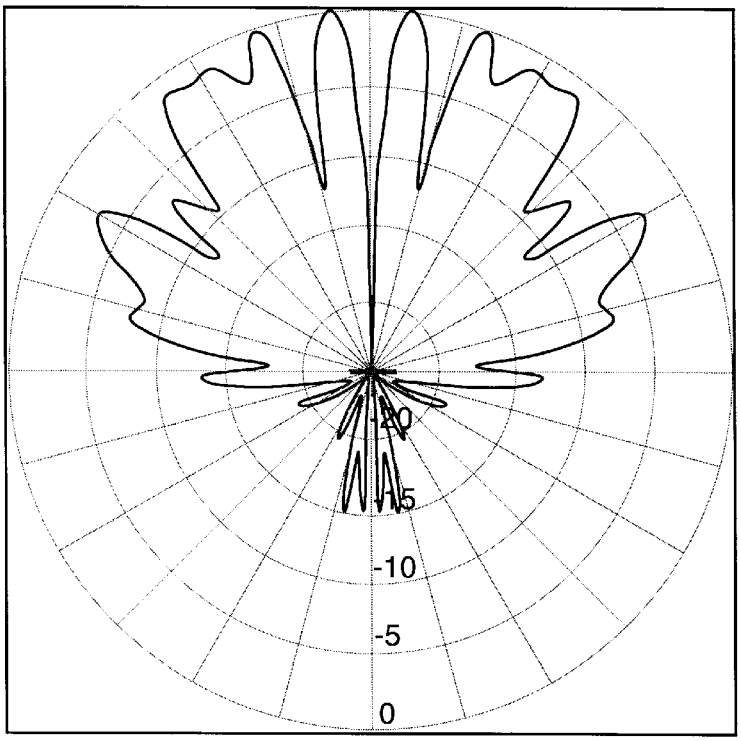
FIG. 10 illustrates the predicted beam pattern of a design example of the present biconical antenna operating at 3 GHz.
Figure 11:
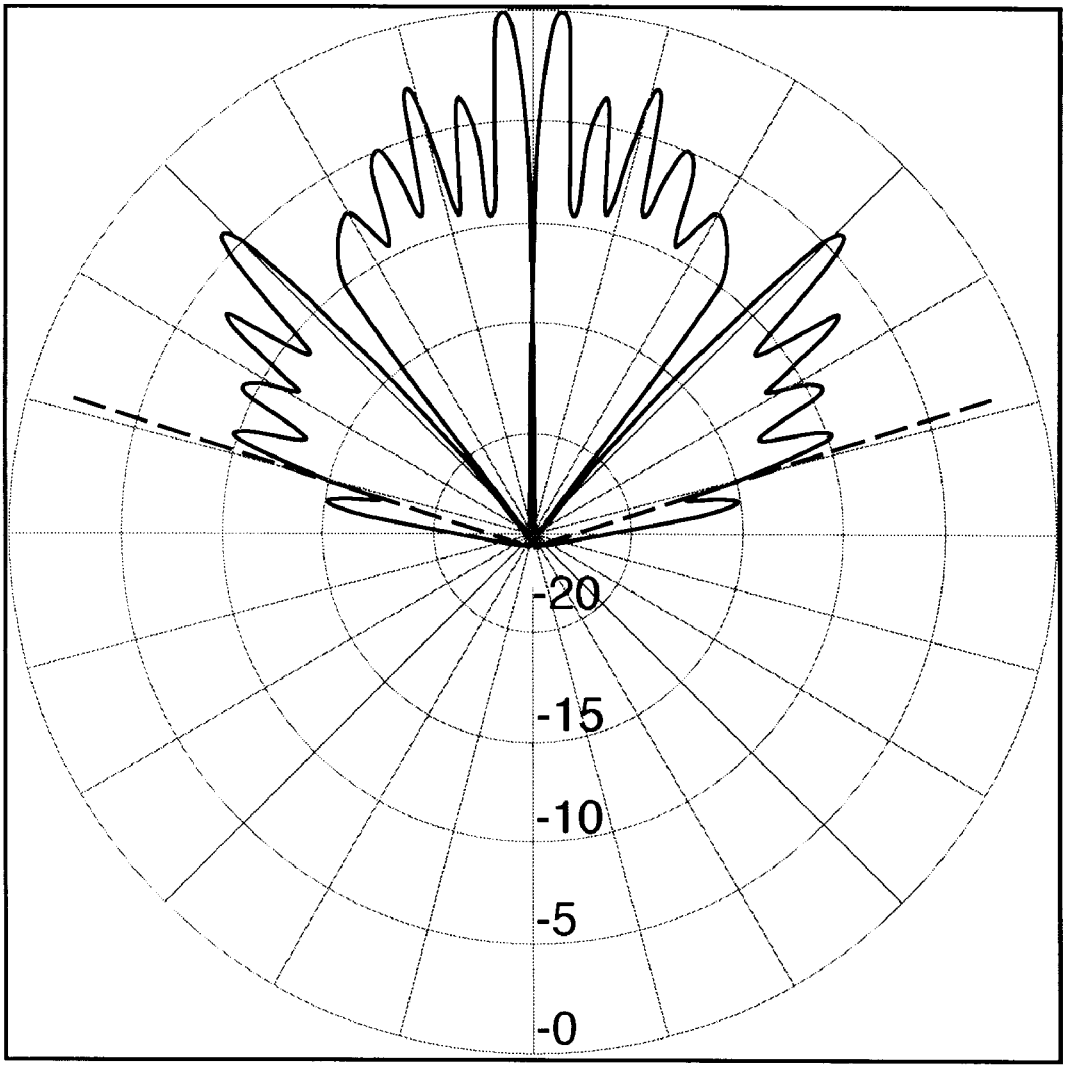
FIG. 11 illustrates the predicted beam pattern of a design example of the present biconical antenna operating at 5 GHz.

As may be seen in FIGS. 9–11, the beam center is slightly lower than desired, which can be compensated for by increasing $\theta_1$ and $\theta_2$ for the second iteration. However, the beam center and width are seen to be relatively constant as a function of frequency, which will ensure relatively good transmission of an ultra-wideband waveform. The beam nulls on the 3 and 5 GHz plots can be corrected as the design is iterated. The patterns in FIGS. 9–11 are for single frequencies. In the time domain, there is a single pattern for a particular waveform. In practice, the ripples and nulls observed in the frequency domain patterns tend to go away in the time domain patterns.

Thus, an improved high-power, shaped-beam, ultra-wideband biconical antenna has been disclosed. It is to be understood that the described embodiment is merely illustrative of some of the many specific embodiments which represent applications of the principles of the present invention. Clearly, numerous and varied other arrangements may be readily devised by those skilled in the art without departing from the scope of the invention.

What is claimed is:

1. A high-power, shaped-beam, ultra-wideband biconical antenna comprising:

a coaxial feed comprising outer and inner conductors;

a lower support structure coupled to the outer conductor of the coaxial feed;

a lower cone coupled to the lower support structure;

an upper support structure coupled to the inner conductor of the coaxial feed;

an upper cone coupled to the upper support structure;

a first dielectric window support coupled between the lower and upper support structures;

a reservoir disposed within a volume defined by the upper support structure cone and a second dielectric window support that is coupled thereto;

a first dielectric material disposed within the coaxial feed and the volume defined by the lower and upper cone support structures, the coaxial feed, and the first dielectric window support, and disposed within said reservoir;

a plurality of air bubble escape holes disposed in the upper support structure that provide a means for air bubbles to escape to the reservoir.

2. The biconical antenna of claim 1 wherein the first dielectric material comprises oil.

3. The biconical antenna of claim 1 wherein a second dielectric material is located between the upper cone and the lower cone and is configured to have a shape that tapers inwardly from the lower and upper cones toward the first dielectric window support.

4. The biconical antenna of claim 1 wherein a second dielectric material is located between the upper cone and the lower cone and is configured to have a shape that tapers outwardly from the lower and upper cones away from the first dielectric window support.

5. The biconical antenna of claim 1 wherein each cone further comprises sheet metal plates that are secured to the lower and upper cone support structures.

* * * * *